US006889699B2

(12) United States Patent
Clarke

(10) Patent No.: US 6,889,699 B2
(45) **Date of Patent: *May 10, 2005**

(54) UMBRELLA FRAME AND OPERATING SYSTEM

(75) Inventor: Dougan H. Clarke, Miami Beach, FL (US)

(73) Assignee: Tuuci Engineering & Design, Inc., Miami, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/008,536

(22) Filed: Nov. 13, 2001

(65) Prior Publication Data

US 2002/0088483 A1 Jul. 11, 2002

Related U.S. Application Data

(63) Continuation-in-part of application No. 09/330,600, filed on Jun. 11, 1999, now Pat. No. 6,314,976.

(51) Int. Cl.[7] ..... A45B 25/14
(52) U.S. Cl. ..... 135/20.3; 135/28; 135/38
(58) Field of Search ..... 135/27–28, 38, 135/39, 43, 98, 20.3, 16

(56) References Cited

U.S. PATENT DOCUMENTS

| | | | | |
|---|---|---|---|---|
| D25,368 | S | * | 4/1896 | Sparry ..... D3/5 |
| 760,598 | A | | 5/1904 | Wynegar |
| 1,328,175 | A | | 1/1920 | Martin |
| D56,043 | S | * | 8/1920 | Weinberg et al. ..... D3/5 |
| 1,801,913 | A | | 4/1931 | Frederick |
| 2,336,116 | A | | 12/1943 | Morando |
| 2,745,421 | A | | 5/1956 | Russell |
| 3,177,882 | A | | 4/1965 | Militano |
| 3,424,180 | A | | 1/1969 | Andolfi |
| 4,368,749 | A | | 1/1983 | Lindler et al. |
| 4,567,907 | A | | 2/1986 | Dubinsky |
| 4,832,304 | A | | 5/1989 | Morgullis |
| 4,834,126 | A | | 5/1989 | Sweet, Jr. |
| 4,928,718 | A | | 5/1990 | Apple |
| 4,993,445 | A | | 2/1991 | Dubinsky |
| 5,020,557 | A | | 6/1991 | Apple |
| 5,174,319 | A | | 12/1992 | Chou et al. |
| 5,193,566 | A | | 3/1993 | Chen |
| 5,337,989 | A | | 8/1994 | Apple |
| 5,355,903 | A | | 10/1994 | Haddad et al. |
| 5,398,709 | A | | 3/1995 | Lee |
| 5,640,984 | A | | 6/1997 | Dubunsky |
| 5,715,853 | A | | 2/1998 | Lin |
| 5,749,386 | A | | 5/1998 | Samuel, Jr. |
| 5,836,328 | A | | 11/1998 | Lee |
| 5,871,024 | A | | 2/1999 | Vanderminden, Sr. |
| 6,076,540 | A | | 6/2000 | You |
| 6,173,721 | B1 | | 1/2001 | Mery |

* cited by examiner

*Primary Examiner*—Winnie Yip
(74) *Attorney, Agent, or Firm*—Malloy & Malloy P.A.

(57) ABSTRACT

An improved, durable and versatile umbrella frame assembly is provided to more readily endure abusive weather conditions and that may be quickly, easily and inexpensively repaired. In addition, the assembly is also easily modified to accommodate umbrella canopies of different sizes and shapes. In addition, an improved umbrella operating system is provided to permit simple opening, positioning, and locking of an umbrella while allowing the frame to freely rotate about the pole regardless of the degree to which it is opened, while the pole is held in a stationary position. The assembly includes a pair of hub members mounted about a pole member wherein the main hub member is slidable up and down the pole. A pulley system with a locking cam member may be employed to allow the umbrella to safely and easily open to any desired position. A locking stabilizer arm may be used to secure the main hub member in the fully open position.

10 Claims, 11 Drawing Sheets

UMBRELLA FRAME AND OPERATING SYSTEM

CLAIM OF PRIORITY

This is a continuation-in-part patent application of a U.S. patent application filed on Jun. 11, 1999 for an Umbrella Frame, Ser. No. 09/330,600, which is set to mature into U.S. Pat. No. 6,314,976 on Nov. 13, 2001, and of a related U.S. patent application, namely, Ser. No. 09/433,881 filed on Nov. 4, 1999 for an Umbrella Operating System, both of which are incorporated by reference fully herein.

BACKGROUND OF THE INVENTION

1. Field of the Invention

This invention relates generally to umbrellas, and more particularly to a durable and versatile umbrella frame designed to more readily endure abusive weather conditions. The present invention also relates more particularly to an umbrella operating system having improved stabilization qualities and customization features.

2. Description of the Related Art

Outdoor umbrellas are employed to shield people from the sun, wind, rain, and other elements of nature. As such, they are intentionally designed to withstand these elements. Nevertheless, damage to the framework of an umbrella can and does occur for many reasons, particularly to umbrellas in geographical areas of severe and unexpected weather, as well as umbrellas which have been improperly installed. Many prior art umbrellas suffer the disadvantages of not being able to withstand gusts of wind and other harsh weather as well as not being capable of simple repair when damage does occur. For example, an umbrella having static wire, rigid line and an unbalanced construction at the rib and strut pivot point will wear and often break when extreme forces are applied over time. Once an umbrella is damaged, it is often more expensive, time consuming and difficult to repair the umbrella than to just have it replaced.

For umbrellas having individual pivotal connections between the upper rib and lower strut assembly, the unbalanced nature of the movement at the pivot point in relation to the upper and lower central hubs causes unnecessary wear on the pivot junction as well as to the static wire or rigid line which connects the canopy rib assembly to the central hubs. This wear is undesirable and is aggravated over time by the stresses of both man and nature.

For umbrellas having individual pivotal connections between the upper rib and lower strut assembly by means of a vertically configured bracket individually, the existing brackets protrude over the top of the canopy assembly providing a point of friction between the fabric of the canopy and the rigid protrusion of the pivot bracket. This creates excessive wear on a fabric canopy and often creates holes in the fabric canopy.

Various umbrella frames are described, for example, in the following U.S. Pat. Nos.: D25,368 to Sparry; D56,043 to Weinberg et al.; 2,336,116 to Morando; 3,177,882 to Militano; 4,368,749 to Lindler et al.; 4,834,126 to Sweet, Jr.; and 5,715,853 to Lin. None of these umbrella frames show the structure of the invention recited subsequently herein nor the benefits or advantages thereby.

In addition to the foregoing, many have tried to simplify and improve the operational features of the umbrella as well as to add structural stability to the typical umbrella. However, many such efforts have required the use of a crank to open and close the umbrella or require placing one's hand in a compromising position in order to lock and unlock the umbrella from its open position. Such action is often troublesome and inconvenient, and can result in injury.

Accordingly, there remains a need in the art for an umbrella which is structured to withstand high winds and other abusive weather, which in addition, may be quickly, easily and inexpensively repaired when that becomes necessary. If any such umbrella were developed, it would preferably also be easily modified to accommodate umbrella canopies of different sizes and shapes. Further, if any such umbrella were developed it would preferably include an operating system for allowing the umbrella to be easily opened, rotated, and adjusted to various vertical positions and then simply locked in place. Finally, if any such umbrella were developed it would preferably also include a stabilizing system for improving support of the umbrella and providing a safer, more effective way to lock and unlock the umbrella in its fully extended position.

SUMMARY OF THE INVENTION

The present invention is designed to address these and other needs which remain in the art and relates primarily to a durable outdoor umbrella frame that will withstand gusts of wind and other harsh weather and that may be quickly, easily, and inexpensively repaired. In addition, the present invention is also easily modified to accommodate umbrella canopies of different sizes and shapes. Accordingly, and as explained more in detail subsequently herein, the present invention includes a pair of hub members mounted to an umbrella pole member wherein one hub member is slidable between the top and bottom ends of the umbrella pole member. In addition, the hub members are easily mounted on the umbrella pole member, preferably so as to both be rotatable about the pole, and assist in the smooth operation of the umbrella frame. The hub members can be easily removed from the umbrella pole member for repair and/or can be easily replaced, if necessary. Further, the hub members include a plurality of slots about their radial edges for receiving a combination of hub connector joints. A matching number of ribs and struts are pivotally secured to each hub by these joints, and the struts are pivotally secured to the ribs by collar members. The hub connector joints and the collar members are easily mounted and replaced, and also assist in the smooth operation of the umbrella frame. Additionally, the collar members maintain a low profile so as to avoid contacting and thereby potentially damaging a mounted canopy.

The present invention also provides a versatile umbrella operating system which allows an umbrella to be safely and easily opened to almost any degree, easily rotated, and securely stabilized. As such, the present invention includes an operating system to allow the umbrella to be easily adjusted to almost any degree of openness and simply locked in place. In a preferred embodiment, the operating system comprises but is not necessarily limited to a pulley system connecting or interconnected with the hub members and structured to move the one hub member up and down a length of the pole towards the other hub member, preferably disposed at the top of the pole. The operating system may include a stabilizer arm to achieve the opening and/or closing of the umbrella and/or to bolster support to the umbrella and provide a safer, more effective way to lock and unlock the umbrella in its fully extended position. In addition, a base plate member having a flip lid attachment may be employed to provide stability at the bottom end of the umbrella, as well as to provide a means to keep the umbrella base opening covered when the umbrella is removed.

One primary object of the present invention is to provide an umbrella frame capable of withstanding both hot and cold temperatures, high wind conditions and other harsh weather.

It is another object of the present invention to provide an umbrella frame which can be easily manipulated to allow the attachment of canopies of varying shapes and sizes.

It is a further object of the present invention to provide an umbrella frame capable of simple rotation, such as about a pole member or otherwise.

It is another object of the present invention to provide an umbrella frame having easily replaceable and interchangeable parts.

Another important object of the present invention is to provide an umbrella assembly capable of being opened to any desired vertical position.

Yet another object of the present invention is to provide an umbrella assembly capable of being opened to any desired vertical position while at the same time being rotatable.

Still another object of the present invention is to provide an umbrella assembly which eliminates the need for and/or does not have to rely upon a crank lift to open and close the umbrella assembly.

It is yet another object of the present invention to provide an umbrella assembly which eliminates the need for and/or which does not have to rely upon a security pin beneath the lower movable hub member to retain the umbrella in a desired vertical position.

The foregoing list of objects for the invention is meant to be illustrative only and should not be considered to be limiting in any sense. As such, these and other objects, features and advantages of the present invention will become more clear and/or may be gleaned from the detailed description of the invention in various preferred embodiment(s), set forth below.

DETAILED DESCRIPTION OF THE PREFERRED EMBODIMENT

Figure 1:
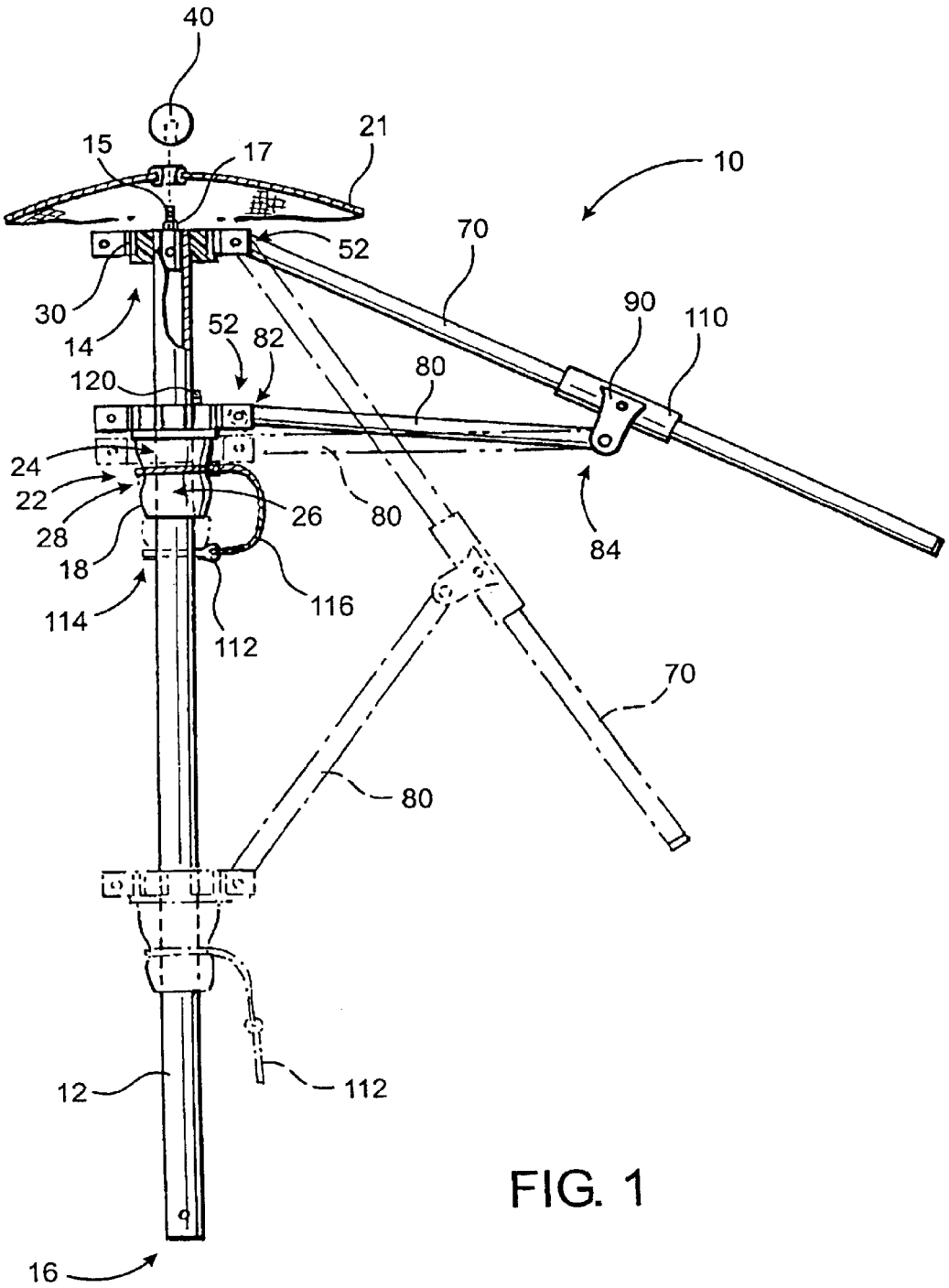
FIG. 1 is a partial exploded front elevational view in partial cross-section of an umbrella frame assembly of the present invention in an embodiment utilizing a retaining pin, with the umbrella closed position shown in phantom.

As shown throughout the various Figures, the present invention relates to an improved umbrella frame and operating assembly.

With initial reference to FIGS. 1 through 8, an improved umbrella frame assembly, generally indicated by reference numeral 10, according to the present invention will now be described. The umbrella frame assembly 10 is intended for use in easily and quickly supporting a variety of shapes and sizes of umbrella canopies, and is structured to be both durable and weather resistant. As illustrated in these Figures, the frame assembly 10 includes a longitudinally extending pole member 12 which can be made of wood, aluminum or other material. In one embodiment, the pole member 12 is made of 40 gauge aluminum. The pole member 12 has a top end 14 and a bottom end 16. The bottom end 16 may be easily secured to the ground or any means of vertical affixment, such as but not limited to a reinforced concrete base, which for example, might have a star knob and hitch pin. The bottom end 16 of the pole member 12 might also be connected to a suitable sturdy base having one or more wheels incorporated therein so as to render the overall umbrella and frame movable between various locations.

Figure 2:
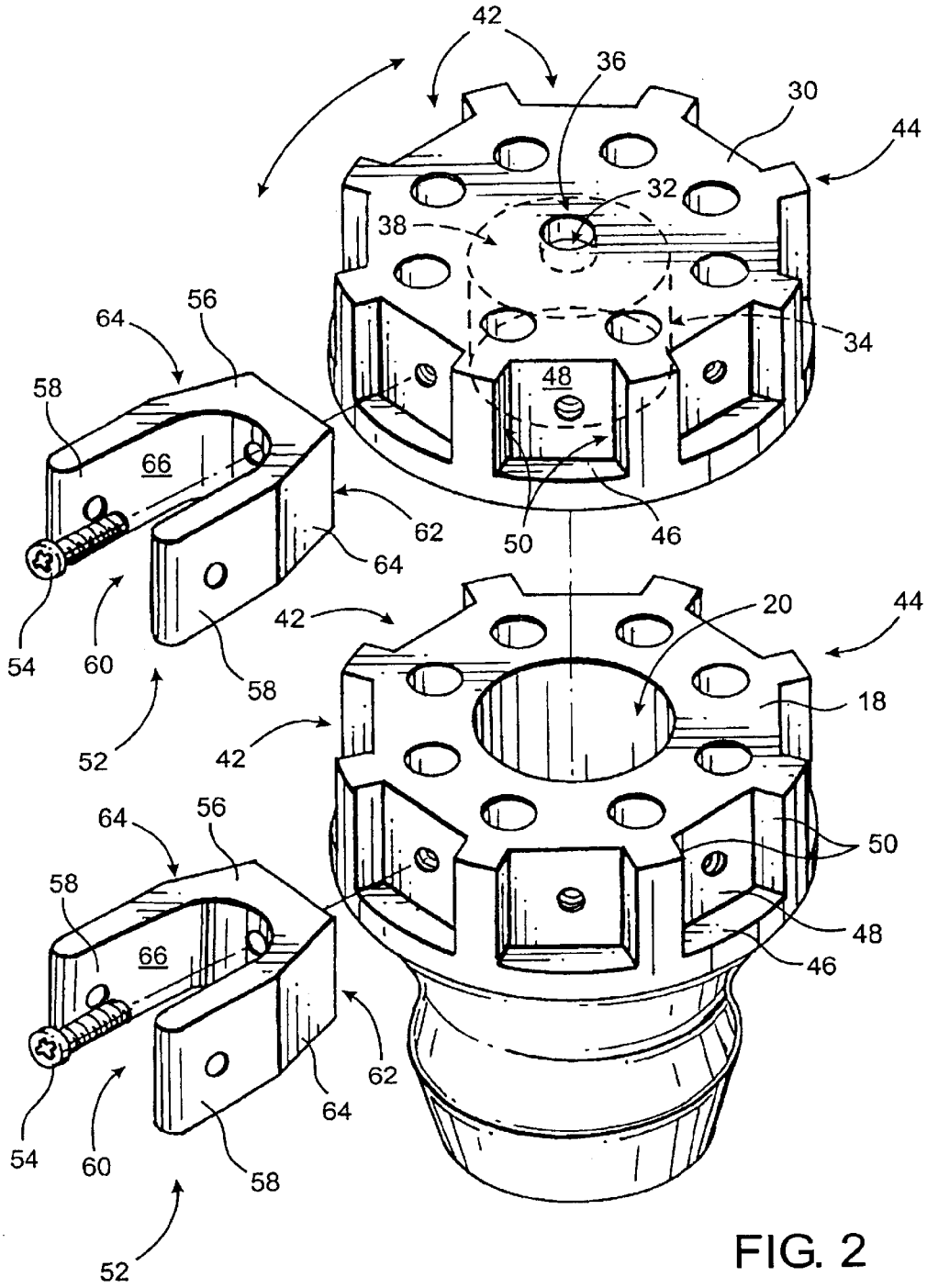
FIG. 2 is an exploded perspective view of a preferred main hub member and a secondary hub member according to the present invention and also illustrating preferred hub connector joints.

The umbrella frame assembly 10 also comprises a pair of hub members. As best shown in FIGS. 1 and 2, preferably the assembly includes a main hub member 18, having a central cavity 20 extending axially therethrough, which is secured about the pole member 12 and is slidable between the top end 14 and bottom end 16 of the pole member 12. The main hub member 18 is also capable of rotating about a longitudinal axis of the pole member 12. In one embodiment of the invention, as shown in the Figures, the main hub member 18 is provided with a substantially "hour glass" shaped base portion 22 having an upper portion 24 and a lower portion 26 and a waist portion 28 which is of smaller diameter than the upper portion 24 and lower portion 26. The shape of the base portion 22 is more comfortably structured to allow for simple hand manipulation of the hub member 18 up and down the pole member 12.

As shown throughout the Figures, an upper or secondary hub member 30 is provided near the top end 14 of the pole member 12. The secondary hub member 30 is provided with a central cavity 32 extending axially therethrough, wherein the cavity includes a pole receiving portion 34 and a narrower upper portion 36 which extends through an interior wall 38 of the secondary hub member 30, or simply an aperture formed therein. The interior wall 38 maintains the secondary hub member 30 in position at the top end 14 of the pole member 12. The hub members 18, 30 may be made of injecting molded thermoplastic, such as DELRIN with TEFLON, for example, so as to resist rust, UV degradation, dry rot, and water damage. Other rigid and/or flexible materials may be used.

As illustrated in FIG. 1, in the preferred embodiment of the present invention, a threaded bolt 15 is operatively connected to member 14' and extends from the top end 14 of the pole member 12 through the narrow upper portion 36 of the secondary hub member central cavity 32 such that the secondary hub member 30 is hangably secured to the pole member 12 near its top end 14. While the secondary hub member 30 may be freely rotated about the bolt 15 and the pole member 12 near its top end 14, a nut 17 may be tightened about the bolt 15 which is capable of restricting the movement of and/or of maintaining the secondary hub member 30 in substantially rigid position about the pole member 12. When desired, the nut 17 may be loosened so as to allow the secondary hub member 30 to freely rotate about the longitudinal axis of the pole member 12. A finial or end cap 40 is preferably also secured to the bolt 15 for aesthetic purposes once a canopy 21 has been positioned atop the umbrella frame assembly 10. The end cap 40 also maintains the canopy 21 in a secured central position.

Figure 17:
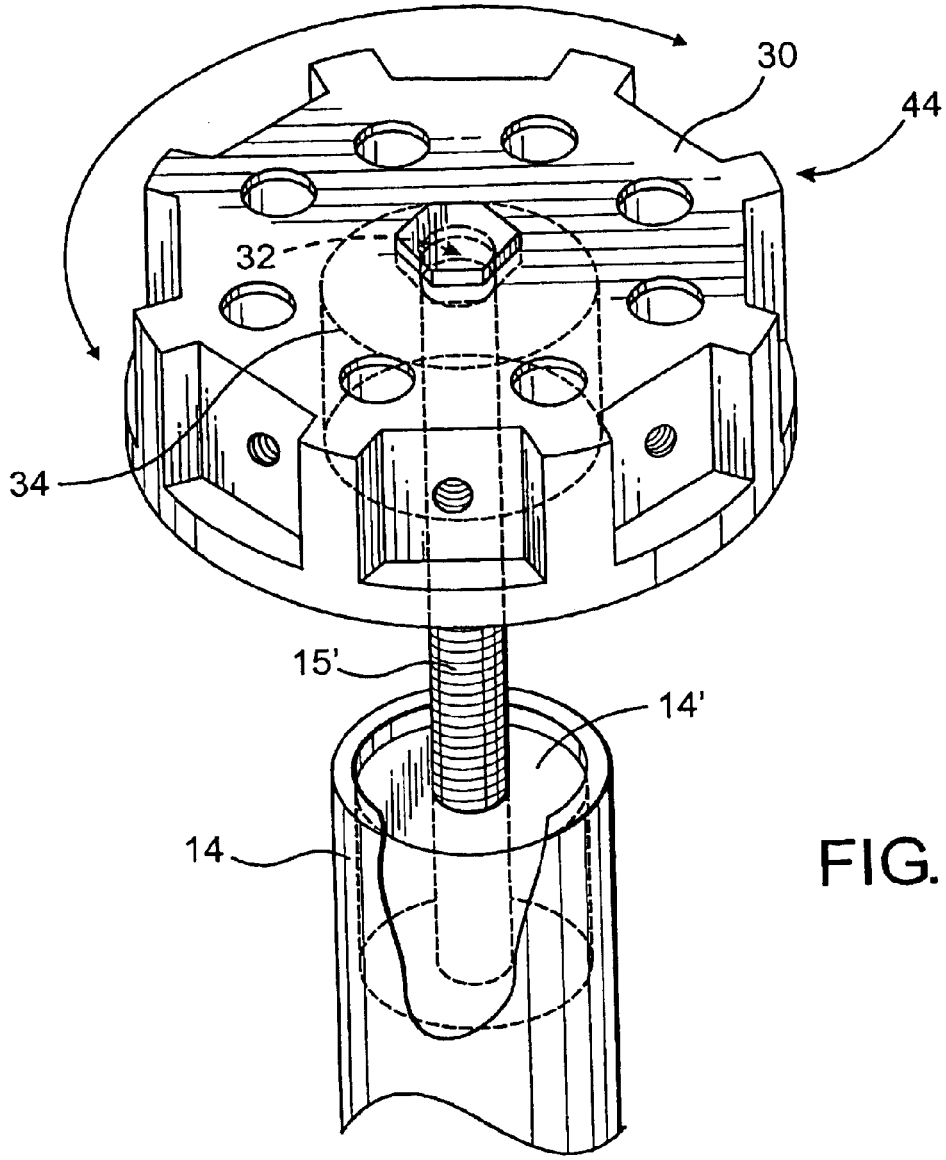
FIG. 17 is a perspective view in partial cutaway of yet another embodiment of the present invention associated with the pole member and secondary hub thereof.

In an alternate embodiment represented in FIG. 17, the secondary hub member 30 may be structured to include a rigid bolt member 15' which extends axially downward through the pole receiving portion 34 of the central cavity 32. In this embodiment, at least the top end 14 of the pole member 12 comprises a partially hollow interior sufficiently sized to receive the rigid bolt member 15' of the secondary hub member 30. positioning the downwardly extending rigid bolt member 15' of the secondary hub member 30 into operative connection with member 14' secured within the at least partially hollow interior of the top end 14 of the pole member 12 facilitates positioning of the pole receiving portion 34 over the exterior of the top end 14, and also provides the capability for the secondary hub member 30 to rotate about the bolt member 15' and the longitudinal axis of the pole member 12 similar to the embodiment of FIG. 1.

As shown in FIG. 2, the main hub member 18 and secondary hub member 30 are preferably further provided with slots 42 formed at intervals about their respective radial edges 44. The slots 42 are ideally three sided and include a base 46, a back wall 48, and a pair of side walls 50. The back wall 48 faces radially outwardly from the hub members 18, 30 and the pair of side walls 50 extend outwardly from the back wall 48 at diverging angles. In one embodiment of the invention, the slots 42 are approximately ¼ inch in depth and the back wall 48 is approximately ¾ inches in width.

As is also shown in FIG. 2, the umbrella frame assembly 10 of the present invention preferably comprises hub connector joints 52 that are insertable within the hub member slots 42 and which may be secured therein by screws 54, for example. The hub connector joints 52 may be made of injection molded thermoplastic or stamped metal, for example. The hub connector joints 52 are provided with a base portion 56 and a pair of substantially parallel side walls 58 which define a hub connector joint aperture 60. The hub connector joints 52 also have a back face 62 and a pair of corner walls 64 which extend outwardly from the back face 62 at diverging angles. The back face 62 and the pair of corner walls 64 mate respectively with the back wall 48 and pair of side walls 50. Thus, the angles with which the corner walls 64 and pair of side walls 50 diverge from the back face 62 and the back wall 48, respectively, are substantially identical. In one embodiment of the invention, this angle is approximately 104 degrees. Providing the slots 42 with three walls 48, 50 and a base portion 46 ensures a snug fit of the hub connector joints 52 within the hub member slots 42 and helps prevent the hub connector joints 52 from twisting or displacing under stress. Further, the depth and width of the slots 42 allow the hub connector joints 52 to be readily secured and removed from within the slots using a screw 54, as shown in FIG. 2. While a screw member 54 is shown as the means of attachment for the hub connector joints 52 within the hub member slots 42, other forms of attachment may be employed, such as a machine threaded bolt, fitted notch or other element which allows the hub connector joints 52 to be easily attached and removed. As shown in FIG. 2, the interior surface 66 of the hub connector joints 52 may be rounded and substantially U-shaped so as to provide clearance for rib and strut members, as described hereinafter. In the embodiment of the invention as shown in FIG. 2, the hub members 18, 30 are each provided with eight slots 42 so as to accommodate up to eight hub connector joints 52. Other numbers of slots may be utilized as well.

Figures 3, 8:
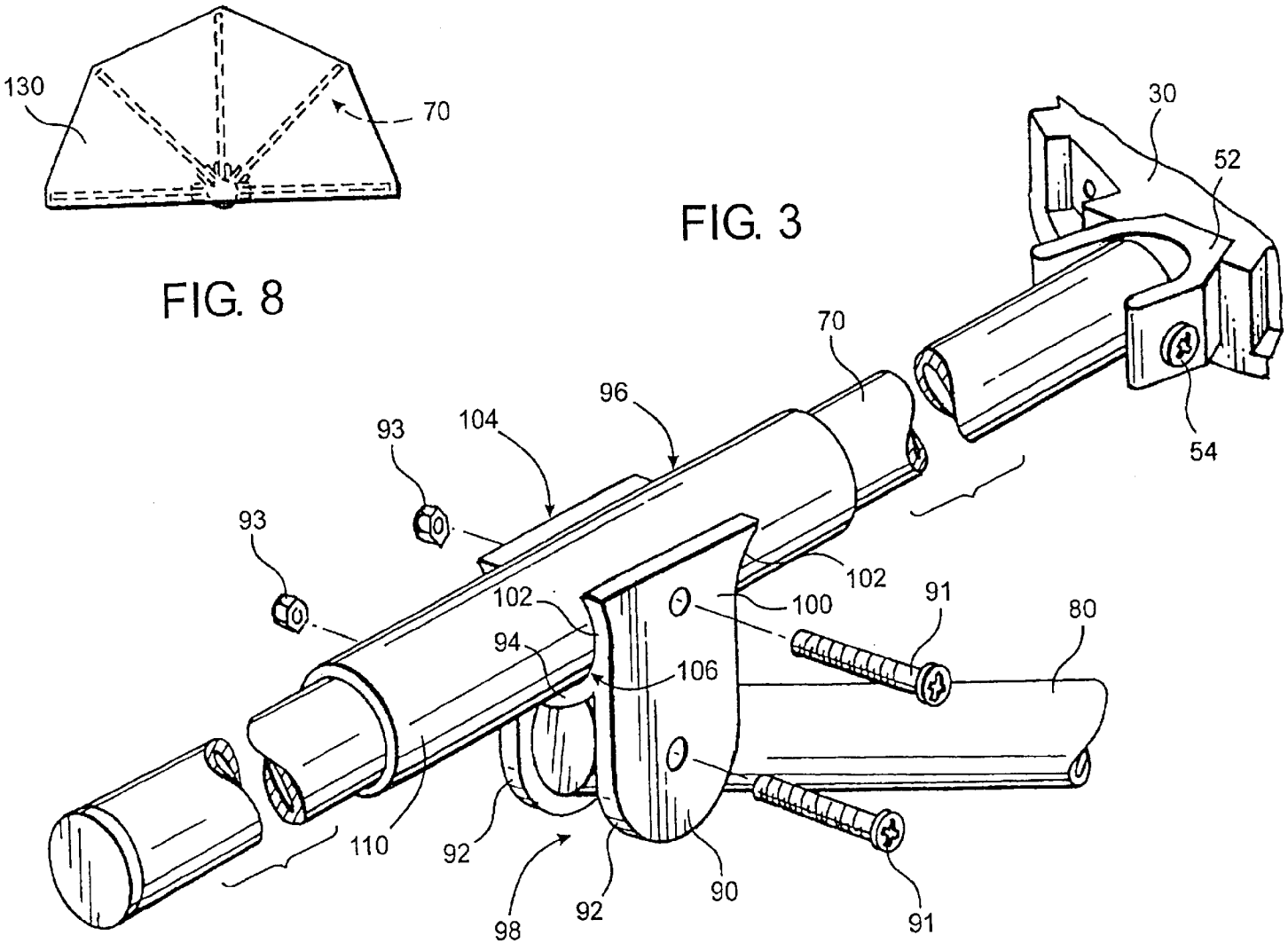
FIG. 3 is an exploded perspective view of a preferred collar member of the present invention.
FIGS. 4 through 8 are top schematic views showing examples of different canopy shapes which may be employed with the present invention.
Figure 4:
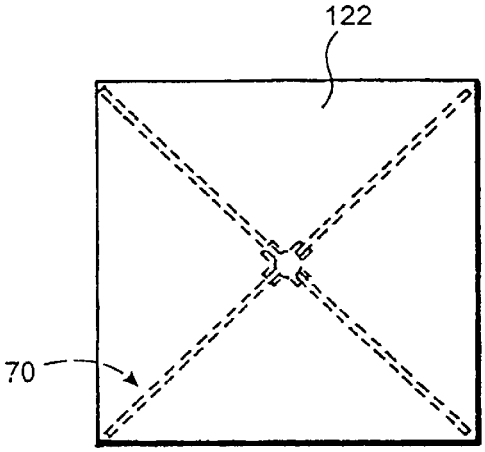
Figure 5:
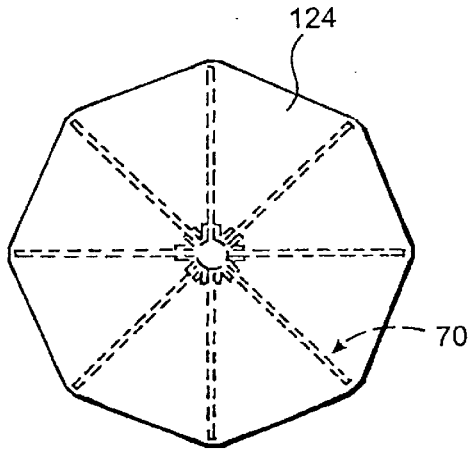
Figure 6:
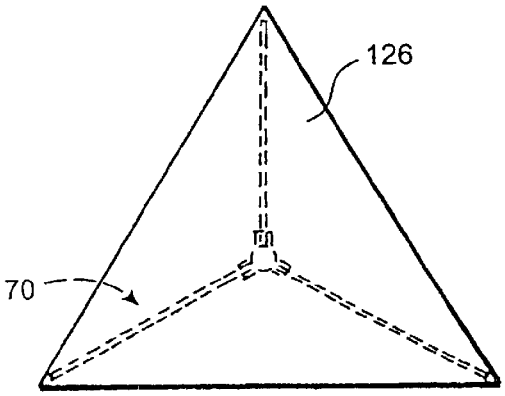
Figure 7:
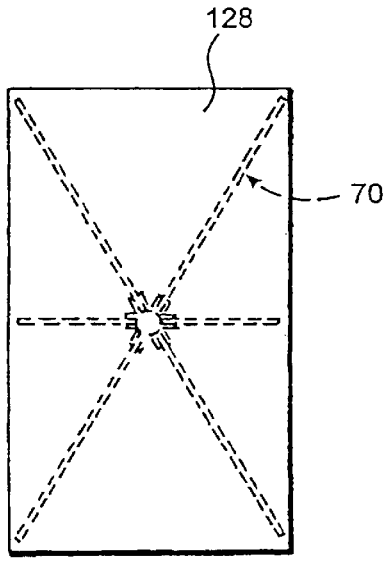

As shown in FIGS. 1 and 3, the umbrella frame assembly 10 of the present invention preferably also comprises rib members 70, which may be pivotally secured to the hub connector joints 52 of the secondary hub member 30. The rib members 70 form the outer framework of the improved umbrella frame assembly 10 of the present invention. Strut members 80 are pivotally secured at an inner end 82 to the hub connector joints 52 of the main hub member 18 and are pivotally secured at an outer end 84 to the rib members 70 at a point near the approximate midpoint of the rib members 70. The strut members 80 provide support for the rib members 70 when the umbrella frame assembly 10 is in the extended or open position, thereby collectively providing a means for supporting the umbrella canopy 21. pivotal attachment of the rib members 70 and the strut members 80 to their respective hub connector joints 52 may be exacted using a single screw 54 extending through the hub connector joint 52 and rib member 70 or strut member 80 However, a machine threaded bolt, a fitted notch or other like joinery that allows the hub connector joints 52 to be easily replaceable may be utilized. The rib members 70 and strut members 80 may be made of a variety of materials such as, by way of example only, aluminum or wood.

As shown in FIG. 3, the strut members 80 are pivotally secured to the rib members 70 by a collar member 90. The collar member 90 includes a pair of substantially parallel outer walls 92 and a central divider wall 94 which combine to define an upper channel portion 96 and a lower slot portion 98 on opposite sides of the divider wall 94. The upper portion 100 of the collar member outer walls 92 which define the channel portion 96 includes outwardly diverging side edges 102 and a substantially flat top edge 104. The channel portion 96 may have a substantially rounded channel portion interior surface 106 adapted for receiving the rib members 70. When the rib members 70 are in a substantially different shape, the channel portion 96 may be adapted to match that shape. As shown in FIG. 3, the channel portion interior surface 106 extends around over one half the circumference of the rib member 70. Also, as shown in FIG. 3, the rib members 70 may be secured within the collar member channel portion 96 by a screw 91 and nut 93. The substantially flat top edge 104 of the collar member 90 avoids contact with the umbrella canopy 21 which is positioned over the rib members 70 and thereby helps prolong the life of the canopy employed. The strut members 80 are pivotally secured to the slot portion 98 of the collar member 90 by a screw 91 and nut 93, as shown in FIG. 3. Also, as shown in FIG. 3, a substantially cylindrical sleeve member 110 may be employed between the collar member 90 and the rib member 70 to reinforce the support provided by the strut member 80 to the rib member 70. In one embodiment of the invention, the sleeve member 110 is made of aluminum.

As discussed more fully later herein with reference to FIGS. 9 through 16, although the main hub member 18 is movably and axially attached to the pole member 12 through central cavity 20 and, therefore, free to both rotate and slide about it, the main hub member 18 may be maintained in a vertical position along the length of the pole member 12 in several ways. For example, and as shown in FIG. 1, one way utilizes a retaining pin 112 attached to the main hub member 18 which can be placed within a retaining pin slot 114 in the pole member 12 in order to maintain the vertical position of the main hub member 18 along the pole member 12. As shown in FIG. 1, the retaining pin 112 can be maintained around the waist portion 28 of the main hub member by a looped line 116 which allows the main hub member 18 to rotate without binding the looped line 116. Thus, the retaining pin 112 is secured to the main hub member 18 in such a manner so as to allow the free rotation of the hub members 18, 30 about the longitudinal axis of the pole member 12 even while the pin 112 is in place within the pin retaining slot 114, thereby maintaining the vertical position of the main hub member 18 along the pole member 12. The main hub member 18 may also be formed of two pieces and may employ ball or roller bearings or the like to allow the two pieces to move independently of one another in a lateral direction, while still moving as a single unit up and down the pole member 12. Such an arrangement allows the retaining pin 112 to remain within its slot 114 and thereby maintain the main hub member 18 in the upper, frame extended, vertical position while allowing the remaining components of the umbrella frame assembly 10 to be freely rotated about the longitudinal axis of the pole member 12.

In operation, any desired number and size of rib members 70 and strut members 80 may be employed, depending on the particular size and shape of the umbrella canopy to be attached. Because the hub connector joints 52 and collar member 90 are so easily installed, many different configurations of the canopy can be achieved with little effort by either increasing or decreasing the number of hub connector joints 52 present on the hub members 18, 30. For example, as shown in FIGS. 4 through 8, four rib members 70 are employed for the square shaped canopy 122 (FIG. 4), eight rib members 70 are employed for the octagonal shaped canopy 124 (FIG. 5), three rib members 70 are employed for the triangular shaped canopy 126 (FIG. 6), six rib members 70 are employed for the rectangular shaped canopy 128 (FIG. 7) and five rib members 70 are employed for the semi-octagonal shaped canopy 130 (FIG. 8). The number of rib members 70 to be employed determines the number of strut members 80, hub connector joints 52, and collar members 90 to be employed. For example, with four rib members 70, four strut members 80, eight hub connector joints 52, and four collar members 90 are employed. For proper operation, the hub connector joints 52 must be secured within corresponding slots 42 in the main hub member 18 and the secondary hub member 30. Other geometrical shapes and sizes of canopies may also be employed using the frame assembly of the present invention.

Canopies of varying shapes and sizes are attached to the umbrella frame by unscrewing the finial or end cap 40 from the top end 14 of the pole member 12 and removing the securing nut 17. The canopy opening is placed over the threaded bolt 15 and the canopy cuffs are placed around the outer ends of the rib members 70. The securing nut 17 and end cap 40 are then placed back onto the threaded bolt 15. In one embodiment of the invention, the canopy members are SUNBRELLA 100% solution-dyed acrylic canopies or any other shade-like or non-shade like material.

Figure 9:
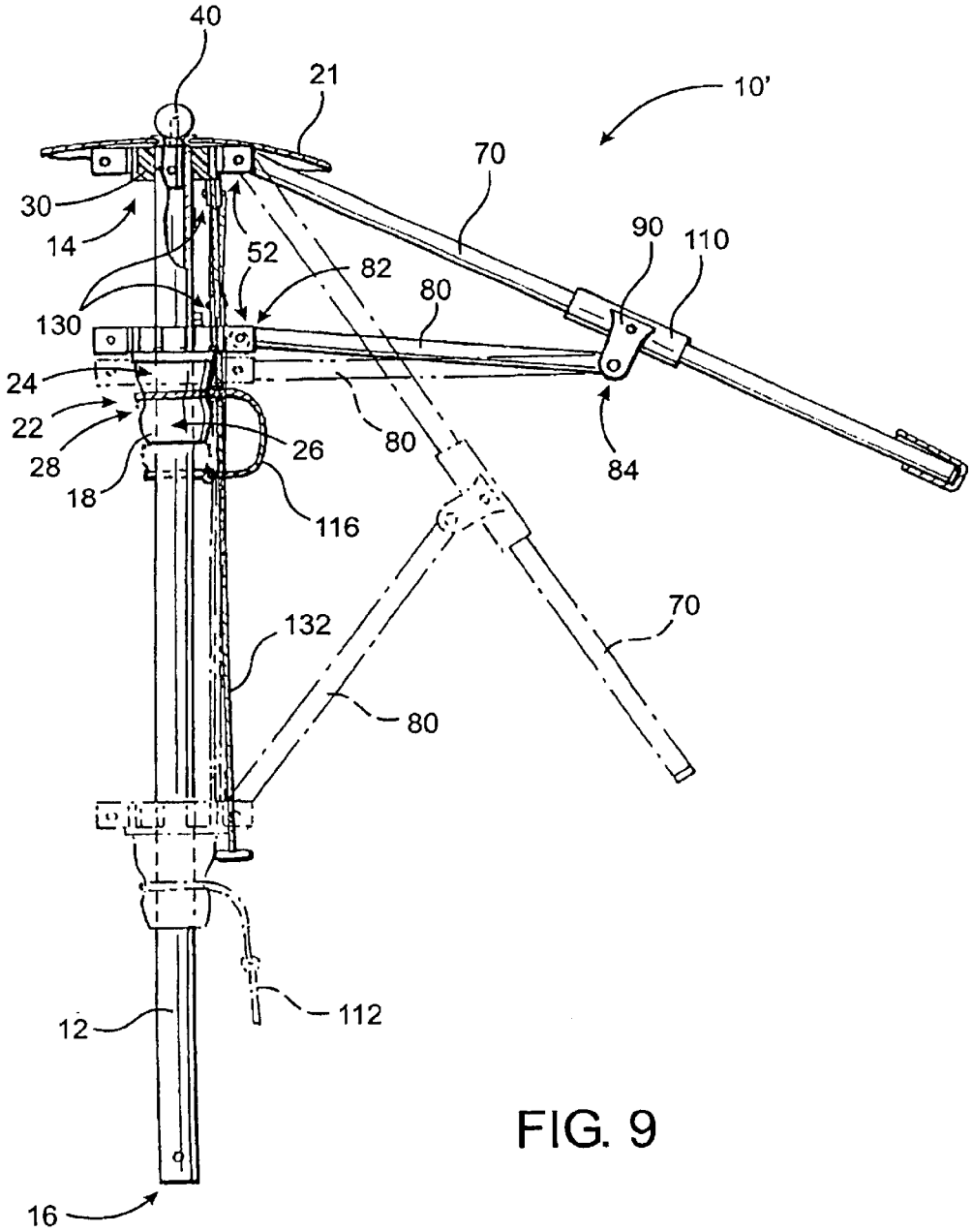
FIG. 9 is a partial front elevational view in partial cross-section of the umbrella frame assembly similar to that shown in FIG. 1, but in an embodiment utilizing a double pulley system.
Figure 11:
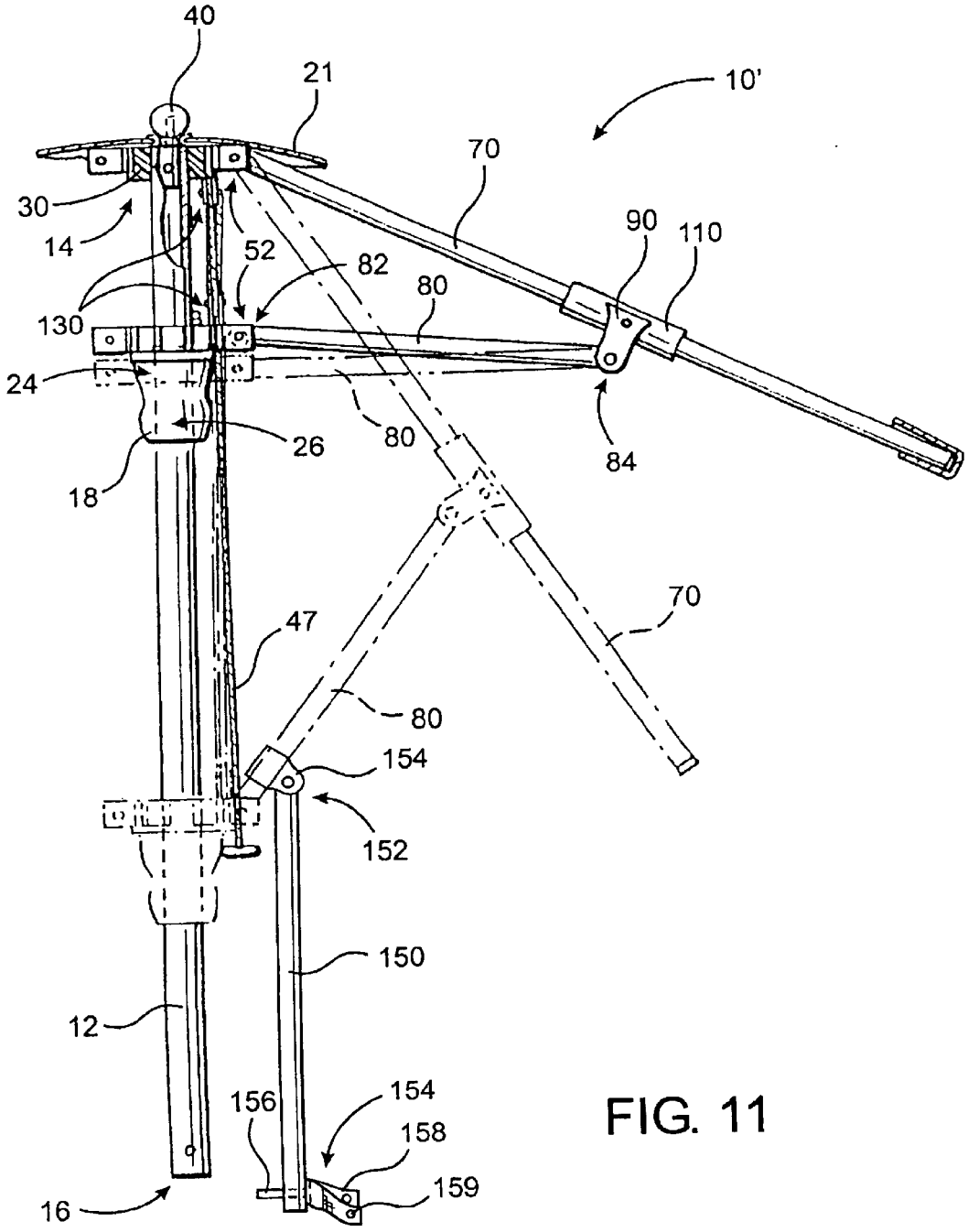
FIG. 11 is a partial front elevational view of the present invention, similar to that shown in FIG. 10, but shown with a stabilizer arm and a pulley system.

When the frame is in the retracted position, as shown in phantom in FIGS. 1, 9, and 11, the main hub member 18 is near the bottom end 16 of the pole member 12. As the main hub member 18 is lifted up the pole member 12, the strut members 80 extend outwardly, thereby expanding the rib members 70 and opening the attached canopy 21. As the strut members 80 pass the point where they extend perpendicularly from the pole member 12, the strut members 80 lock into place against a hub stop member 120 secured to the pole member 12, as shown in solid lines in FIG. 1. The retaining pin 112, described above, can then be placed within the pin retaining slot 114 formed on the pole member 12, and the hub member 18 may then be returned downwardly to rest against the pin 112. In this position, as shown in the dashed lines in FIG. 1, the strut members 80 extend in a substantially perpendicular fashion from the pole member 12 to provide substantial support to the rib members 70.

The hub connector joints 52 and the collar members 90 are also considered to be important inventive steps forward which significantly improve the structural and long term integrity of the improved umbrella frame assembly 10. First, the upper portion 100 of the collar member walls 92 remain below the height of the rib members 70; thus, the collar members 90 avoid contacting the canopy 21 during operation of the umbrella frame assembly 10. Such contact could significantly damage the fabric of the canopy 21. Secondly, the collar members 90 and the hub connector joints 52 help maintain the rib members 70 and the strut members 80 in perfect alignment so that the two independent hubs 18, 30 act in concert throughout the continual opening and closing of the umbrella frame assembly 10. The upper channel portions 96 of the collar members 90 cradle the rib members 70 and the slot portions 98 of the collar members 90 as well as the hub connector joint apertures 60 straddle their respective ends of the rib members 70 and strut members 80 and allow ease of pivotal motion. Due to the interchangeable and easily replaceable nature of the hub connector joints 52 and collar members 90, a broken umbrella frame assembly 10 may be repaired quickly, easily and with minimal cost to the consumer. Different textures and colors of the hub members 18, 30, the hub connector joints 52, and the collar members 90 are also available.

The umbrella frame assembly 10 may also be easily rotated about the longitudinal axis of the pole member 12 by loosening the end cap 40 and securing nut 17 from the pole member top end 14 and rotating the hub members 18, 30 to their desired location. The umbrella frame assembly 10 may also employ a pulley system, described more in detail below, such as that shown in FIG. 9 at reference numeral 130, to allow the user to pull the pulley cord 132 to initiate the raising of the main hub member 18 and thereby the opening the umbrella frame assembly 10.

Figure 10:
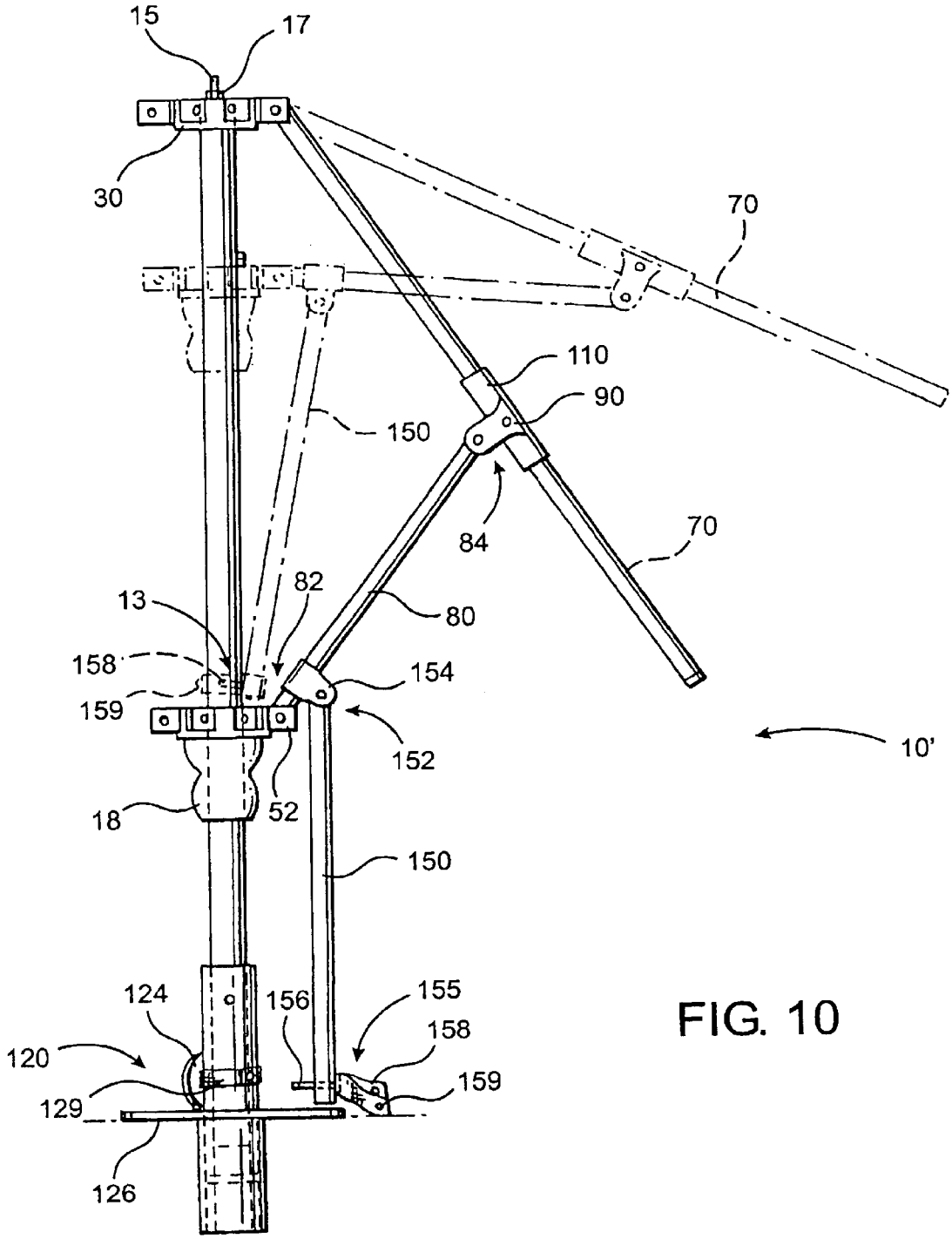
FIG. 10 is a partial front elevational view of another embodiment of the umbrella operating system of the present invention, shown with stabilizer arm and support assembly and with the open position of the umbrella shown in phantom.

With reference now to FIGS. 9 through 16, the improved operating system for the umbrella frame assembly, generally indicated by reference numeral 10', of the present invention will now be described, which is advantageously used in stabilizing an umbrella and in easily and quickly opening, closing and rotating an umbrella. As mentioned previously herein, the main hub member 18 may be maintained in a vertical position along the pole member 12 in several ways. As an example, FIG. 9 illustrates the invention utilizing the retaining pin 112 attached to the main hub member 18 which can be placed within the retaining pin slot 114 in the pole member 12 in order to maintain the vertical position of the main hub member 18 along the pole member 12, while permitting the rotation of the main hub member 18 about the longitudinal axis of the pole member 12. Alternatively, the means for maintaining the main hub member 18 in the vertical position along the pole member 12 may include a stabilizer arm 150, as shown in FIGS. 10 and 11, or the pulley system 130 as generally shown in FIGS. 9 and 11, and as shown in detail in FIGS. 13 through 16.

As shown in FIG. 10, the main hub member 18 may be maintained in a vertical position about the pole member 12 using a stabilizer arm 150. The stabilizer arm 150 is secured at a first end 152 to a strut member 80 by a collar member 154 similar to collar member 90. The second end 155 of the stabilizer arm 150 is provided with a securing member 156 for operably coupling the second end 155 to the pole member 12. In one embodiment of the invention, securing member 156 is a set screw for insertion into a stabilizer opening 13 on the pole member 12. The securing member 156 may also be a pinchable clamp member or other component capable of simple insertion and removal from the stabilizer opening 13. The second end 155 of the stabilizer arm 150 is also provided with a locking strap member 158 which can be positioned around the pole member 12 and locked together such as by using a snap 159 for added support and to ensure that securing member 156 does not unintentionally slip out of position from within the stabilizer opening 13. Using the stabilizer arm 150, the umbrella main hub member 18 can be lifted and lowered without having to use a crank member or a retaining pin 112 at a location high up on the pole member 12. This facilitates the overall ease of use of the umbrella in quickly opening, securing, and closing the umbrella frame assembly 10'.

As shown generally in FIGS. 9 and 11, and in detail in FIGS. 13 through 16, the main hub member 18 may also be moved up and down the pole member 12 using a pulley system 130. The pulley system 130 allows for an effortless lift of the main hub member 18 and eliminates the need for a crank lift or the retaining pin 112 beneath the main hub member 18. The pulley system 130 of the present invention allows the remote locking of the main hub member 18 in a vertical position along the pole member 12 while permitting the rotation of the entire umbrella frame assembly 10', including the main hub member 18 and the secondary hub member 30, and the associated rib members 70, strut members 80, pulley system 130, and umbrella canopy 21 attached thereto, about the longitudinal axis of the pole member 12.

Figure 14:
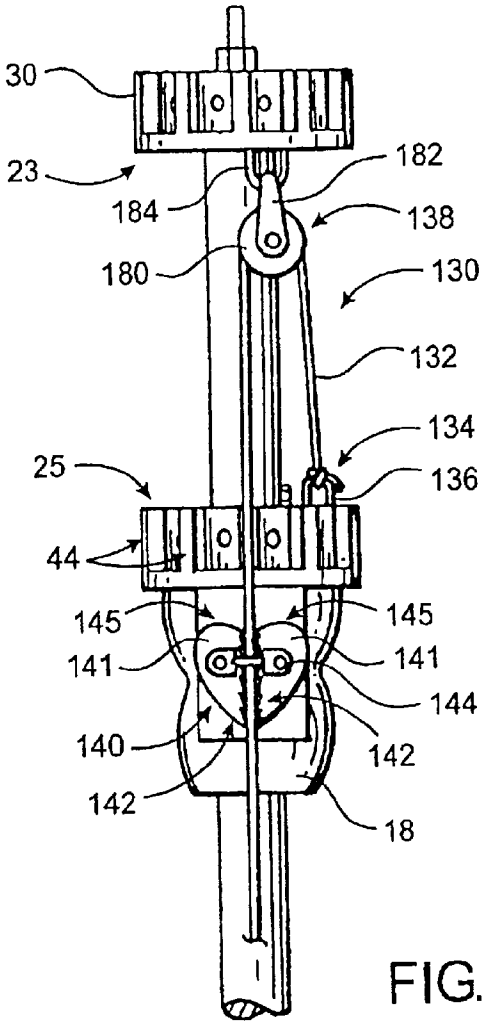
FIG. 14 is a partial side elevational view of another embodiment of a pulley system which may be utilized with the umbrella operating system of the present invention.

In the embodiment of the invention as shown in FIG. 14, the pulley system 130 includes a line member 132 having a first end 134 secured to a bracket member 136 which is secured to the top surface 25 of the main hub member 18. The line member 132 maybe a length of rope, for example. In this embodiment, a pulley member 138 is secured to the bottom surface 23 of the secondary hub member 30 and a cam cleat member 140 is secured to an exteriorly exposed surface of the base portion 22 of the main hub member 18. The pulley member 138 may be a typical pulley having a grooved wheel 180 rotatably mounted to a collar member 182 wherein the collar member is movably secured to a bracket member 184. The pulley system 130 of the present invention allows the operator to open and maintain the umbrella in any desired position along the pole member 12 without any additional locks, pins, or levers by simply pulling the line 132 through the automatic locking cam cleat member 140.

As shown in FIG. 14, the cam cleat member 140 includes a pair of cams 141 each having a toothed side edge 142, and a retaining bracket portion 144. The pair of cams 141 are pivotally mounted to the exteriorly exposed surface of the base portion 22 of the main hub member 18 and the retaining bracket 144 is mounted to the pair of cams 141. In a rested position, as shown in FIG. 14, the toothed side edges 142 of the pair of cams 141 face one another. In this embodiment, the line member 132 extends from the bracket member 136 through the pulley member 138 and down through the pair of cams 141. A handle may be secured to the second end of the line member 132 to promote ease of operation.

Using the pulley system 130 when the umbrella is in its closed position with the main hub member 18 near the bottom end 16 of the pole member 12, the user can pull the line member handle whereby the line member 132 will be pulled through the pulley member 138 and the toothed side edges 142. This will cause the pair of cams 141 to pivot such that the line member 132 will continue to be pulled against the cam smooth outer surfaces 145. This will pull the bracket member 136 and main hub member 18 upward so as to open the umbrella. When the user stops pulling the line member 132, the cams 141 will reverse pivot and the toothed side edges 142 will engage and prohibit the movement of the line member 132 in either direction. The main hub member 18 will thereby be maintained in a vertical position along the pole member 12 while permitting rotation of the main hub member 18 and the secondary hub member 30, and the associated rib members 70, strut members 80, pulley system 130, and umbrella canopy 21 attached thereto, about the longitudinal axis of the pole member 12. In this way, the umbrella can be quickly and easily opened to and maintained at any desired position without the use of a hand crank or the retaining pin 112 placed below the main hub member 18. When the umbrella is desired to be closed, the line member 132 can be pulled outside of the grip of the toothed side edges 142 and released. The retaining bracket 144 maintains the line member 132 in alignment with the toothed side edges 142 such that the user can easily re-engage the line member 132 with the toothed side edges 142 so as to lock the line member 132 at the desired vertical position. Only the intentional removal of the line member 132 from the toothed side edges 142 with a deliberate sideways and upward movement will allow the umbrella to close. The toothed side edges 142 thus prevents any unintentional closing of the umbrella from wind gusts or other outside forces.

Figure 13:
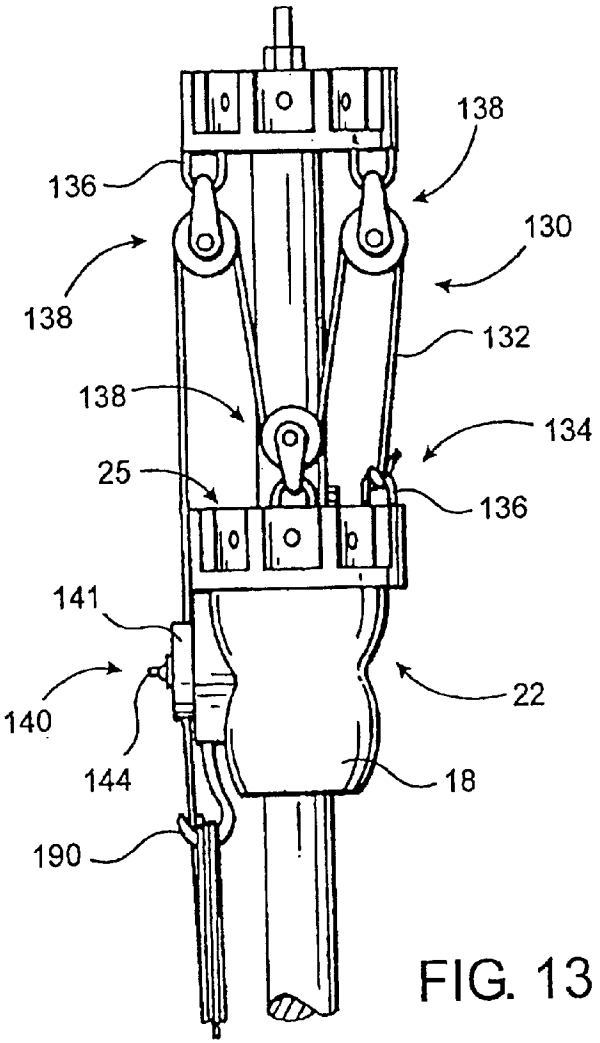
FIG. 13 is a partial side elevational view of one embodiment of a pulley system of the umbrella operating system of the present invention.

As shown in FIG. 14, the pulley system 130 of the present invention may include a single pulley member 138 secured to the bottom surface 23 of the secondary hub member 30 and a bracket member 136 which may be secured to the top surface 25 of the main hub member 18. The pulley system 130 of the present invention may also include first and second pulley members 138 secured to the secondary hub member 30, as shown in FIG. 13. In this arrangement, the line member 132 extends from the bracket member 136 through a first pulley member 138 on the secondary hub member 30, through a pulley member 138 on the main hub member 18, through a second pulley member 138 on the secondary hub member 30 and down through the cam cleat member 140. Such an arrangement provides a mechanical advantage in balance and lifting power to the device. In one embodiment of this arrangement, the first and second pulley members 138 of the secondary hub member 30 are spaced substantially radially equidistant from the axis of the secondary hub member 30. Other variations on the number of pulley members 138 employed on each hub member 18, 30 may be used. Since the hub members 18, 30 are rotatable about the longitudinal axis of the pole member 12, when the nut 17 is loosened, and the pulley system 130 secured to the hub members 18, 30, this arrangement provides the umbrella of the present invention with the ultimate in versatility, as the umbrella may be opened, rotated, and maintained in any desired position completely free of impediments.

As shown in FIG. 13, the line member 132 extends downwardly from the pulley member 138 so as to be substantially coplanar with a main hub member slot wall 44. This keeps the line member 132 free from contact with a hub connector joint 52 which could bind and cause unnecessary wear on the line member 132. Also, as shown in FIG. 12, the line member 132 may be retained on a hook member 190 secured to the exteriorly exposed surface of the base portion 22 of the main hub member 18.

Figure 16:
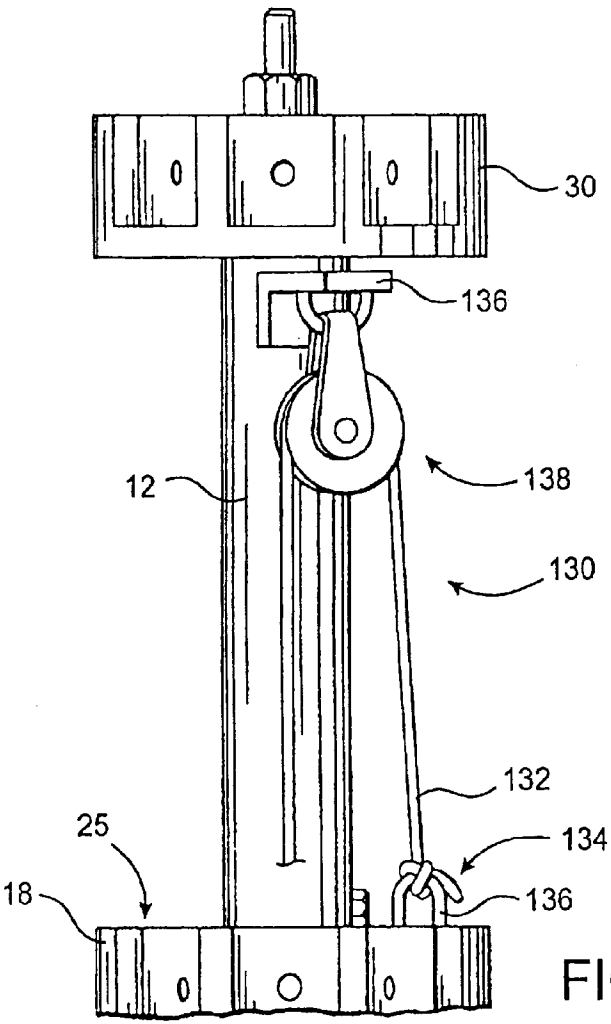
FIG. 16 is a partial side elevational view of another embodiment of the pulley system of the umbrella operating system of the present invention.
Figure 15:
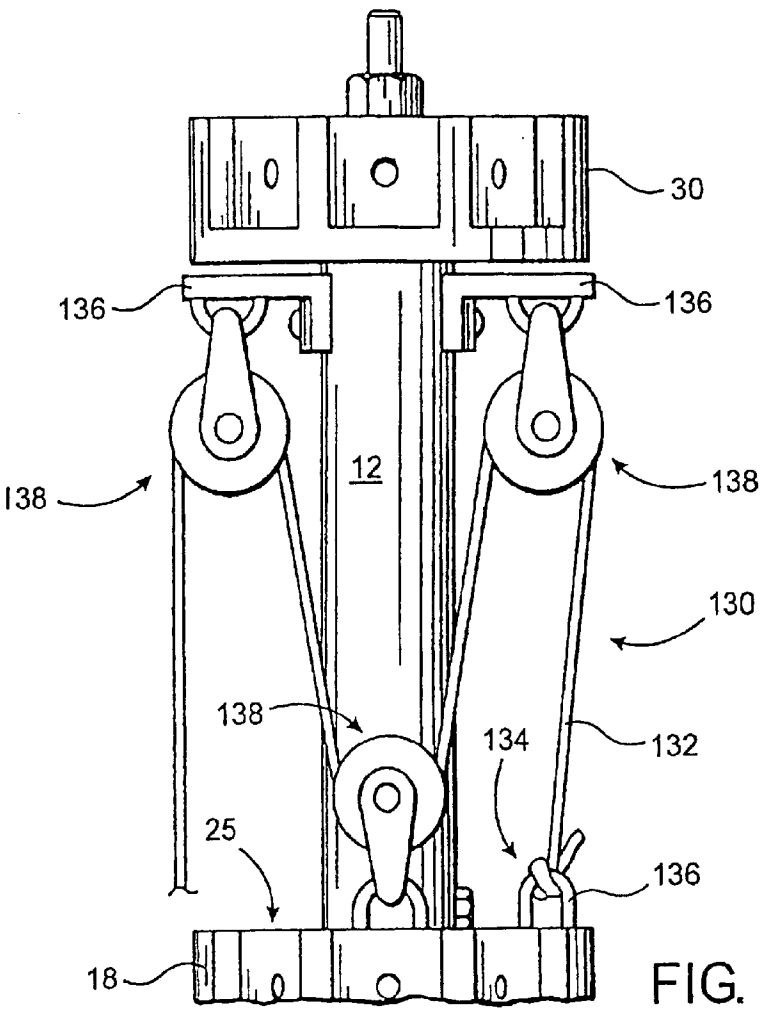
FIG. 15 is a partial side elevational view of one embodiment of the pulley system of the umbrella operating system of the present invention.

As shown in FIGS. 15 and 16, the secondary hub pulley members 138 may optionally be secured directly to the pole member 12 by bracket members 136 which can extend substantially perpendicularly from the pole member 12, for example. In this embodiment, the hub members 18, 30 are prohibited from freely rotating about the pole member 12 because they are interconnected to the pulley system 130, which is at least partially secured to the pole member 12 by bracket members 136.

Figure 12:
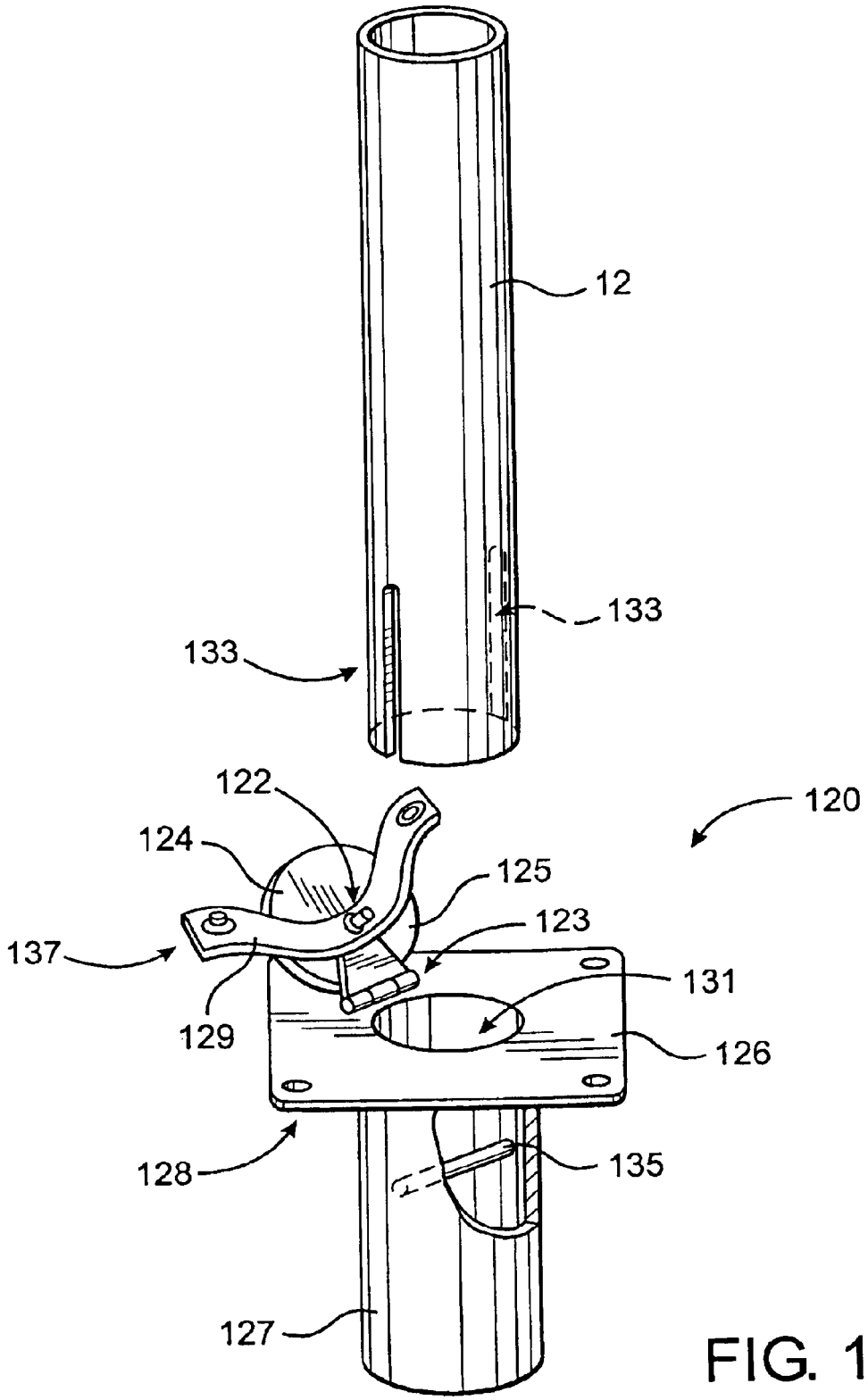
FIG. 12 is an exploded perspective view of the support assembly which may be included within the umbrella operating system of the present invention.

As shown in FIGS. 10 and 12, the pole member 12 may be stabilized at its bottom end 16 of the pole member 12 using a support assembly 120. The support assembly 120 includes a base 126 having a plate member 124 secured thereto by a hinge member 123, wherein the plate member 124 has a pin member 122 extending from its inside surface 125. The pin member 122 is receivable by an opening on the bottom end 16 of the pole member 12. The base 126 includes a substantially cylindrical tube portion 127 extending from its bottom surface 128 and a base opening 131 extending through the tube 127 for receiving the pole member 12. In one embodiment of the invention, the pole member 12 is provided with a pair of axial slots 133 for mating with a securing rod 135 within the tube 127. The plate member 124 is hingedly secured to the base 126 such that, when the pole member 12 is removed, the plate member 124 can cover the base opening 131 so as to prevent rain, trash, feet and hands, and other like elements from falling into the base opening 131. In one embodiment of the invention, the pin member 122 is a set screw. In a further embodiment of the invention the pin member 122 can be a pinchable clamp member insertable and removable from the pole opening by pinching the sides together. A strap member 129 may also be attached to the plate member 124 and secured about the pole member 12 for added support. In one embodiment, as shown in FIG. 12, the strap member includes a snapping lock mechanism 137.

The rigidity and density of all the components described herein can be tempered for a desired flexibility as needed. For example, the pole member 12, rib members 70, and strut members 80 may be comprised of metal, wood or fiberglass but their construction would not be limited to these rigid compositions. The nature of thermoplastic construction with materials like ABS, DELRIN, POLYPROPOLYNE and other ACETALS allow for a degree of flexibility in the hubs connector joints 52, collar members 90, pulley members 138, and cam cleat members 140 of the umbrella frame. Because these plastics have a degree of flexibility, the energy that normally would be absorbed by a completely static frame umbrella is distributed through all of the plastic components of the umbrella in heavy wind conditions or other harsh weather, and thus, use of such materials is preferable as it should greatly increase the life of the static frame of an outdoor umbrella, which is generally the more costly portion of an umbrella unit.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. An umbrella frame comprising:

a pole member having a longitudinal axis, a bottom end and a top end, said pole member including a bolt extending from said top end, a secondary hub member supported on said pole member near said top end thereof, said secondary hub member including a central cavity extending axially there through, said central cavity having a first diameter sized to receive at least said top end of said pole member therein and having a second diameter sized to receive said bolt therein such that said secondary hub member is capable of rotating about said longitudinal axis of said pole member, a main hub member movably secured about said pole member and capable of sliding between said bottom end and said top end of said pole member and further capable of rotating about said longitudinal axis of said pole member, a plurality of rib members pivotally secured to said secondary hub member, a plurality of strut members each having an inner end and an outer end, said inner ends being pivotally secured to said main hub member, said outer end of each of said strut members being pivotally secured to a respective one of said rib members, and means for maintaining said main hub member in position along said pole member while permitting rotation of said main hub member about said longitudinal axis of said pole member.

2. The umbrella frame of claim 1 wherein said means for maintaining said main hub member in said position comprise a cam cleat member.

3. The umbrella frame of claim 1 wherein said means for maintaining said main hub member in said position comprise a stabilizer arm having first and second ends, said first and being secured to one of said strut members and said second end being operably coupled to said pole member.

4. The umbrella frame of claim 1 wherein said means for maintaining said main hub member in said position comprise a retaining pin capable of being placed within a retaining pin slot formed in said pole member.

5. An umbrella frame comprising:

a pole member having a longitudinal axis, a bottom end and a top end, wherein at least said top end of said pole member includes an at least partially hollow interior, a secondary hub member supported on said pole member near said top end thereof, said secondary hub member including a central cavity extending axially there through sized to receive at least said top end of said pole member therein, said secondary hub member including a rigid bolt member extending downwardly and into said at least partially hollow interior of said pole member such that said secondary hub member is capable of rotating about said longitudinal axis of said pole member, a main hub member movably secured about said pole member and capable of sliding between said bottom end and said top end of said pole member and further capable of being rotated about said longitudinal axis of said pole member, a plurality of rib members pivotally secured to said secondary hub member, a plurality of strut members each having an inner end and an outer end, said inner ends being pivotally secured to said main hub member, said outer end of each of said strut members being pivotally secured to a respective one of said rib members, and means for maintaining said main hub member in position along said pole member while permitting rotation of said main hub member about said longitudinal axis of said pole member.

6. An umbrella frame, comprising:

a pole member having a longitudinal axis and a top end and a bottom end, a main hub member secured about said pole member, said main hub member capable of sliding between said bottom end and said top end, a secondary hub member secured to said pole member near said top end of said pole member, a hook member secured to an exteriorly exposed surface of said main hub member for hanging a line member thereon, means for supporting a canopy member, a pulley system for raising and lowering said main hub member along said pole member, and means for maintaining said main hub member in a vertical position along said pole member while permitting rotation of said main hub member about said longitudinal axis of said pole member.

7. An umbrella frame, comprising:

a pole member having a longitudinal axis and a top end and a bottom end, a main hub member secured about said pole member, said main hub member capable of sliding between said bottom end and said top end, a secondary hub member secured to said pole member near said top end of said pole member, means for supporting a canopy member, a pulley system for raising and lowering said main hub member along said pole member, said main hub member including a top surface and a bracket member secured to said top surface of said main hub member, said pulley system including at least one pulley member secured to said secondary hub member and a line member having a first end and a second end, said first end of said line member being secured to said bracket member, said line member cooperatively engaging said at least one pulley member and extending downwardly from said at least one pulley member towards said bottom of said pole member, said secondary hub member including a bottom surface, said at least one pulley member secured to said bottom surface, and means for maintaining said main hub member in a vertical position along said pole member while permitting rotation of said main hub member about said longitudinal axis of said pole member.

8. The umbrella frame of claim 7 wherein said means for maintaining said main hub member in said vertical position includes a cam cleat member secured to an exteriorly exposed surface of said main hub member and wherein said line member cooperatively engages said cam cleat member as it extends downwardly from said at least one pulley member.

9. The umbrella frame of claim 8 wherein said cam cleat member has a rested position and includes a pair of cams pivotally secured to said exteriorly exposed surface of said main hub member, said pair of cams each having a toothed side edge, said toothed side edges facing one another in said rested position of said cam cleat member.

10. The umbrella frame of claim 9 wherein said cam cleat member further includes a retaining bracket secured to each of said pair of cams.

* * * * *